US009926054B2

(12) United States Patent
Berry

(10) Patent No.: US 9,926,054 B2
(45) Date of Patent: Mar. 27, 2018

(54) FLOATATION DEVICE

(71) Applicant: Tyler Ryan Berry, Folsom, CA (US)

(72) Inventor: Tyler Ryan Berry, Folsom, CA (US)

(73) Assignee: Tyler Ryan Berry, Monument, CO (US)

( * ) Notice: Subject to any disclaimer, the term of this patent is extended or adjusted under 35 U.S.C. 154(b) by 0 days.

(21) Appl. No.: 14/926,522

(22) Filed: Oct. 29, 2015

(65) Prior Publication Data

US 2017/0297664 A1 Oct. 19, 2017

(51) Int. Cl.

| | |
|---|---|
| ***B63C 9/11*** | (2006.01) |
| ***B63C 9/15*** | (2006.01) |
| *B63C 9/13* | (2006.01) |
| *A41D 13/012* | (2006.01) |

(52) U.S. Cl.

CPC ..... *B63C 9/11* (2013.01); *B63C 9/155* (2013.01); *A41D 13/0125* (2013.01); *B63C 2009/131* (2013.01)

(58) Field of Classification Search

CPC ..... B63C 9/087; B63C 9/093; B63C 9/105; B63C 9/13; B63C 2009/131; B63C 2009/133; B63C 9/135; B63C 9/15; B63C 9/155; B63C 9/11; B63C 9/115; B63C 9/125; B63C 9/1255; A41D 13/0125

See application file for complete search history.

(56) References Cited

U.S. PATENT DOCUMENTS

| | | | | |
|---|---|---|---|---|
| 5,738,557 | A * | 4/1998 | Biesecker | B63C 9/1255 441/118 |
| 5,950,240 | A * | 9/1999 | Carpenter | A41D 19/0041 2/123 |
| 7,104,858 | B1 * | 9/2006 | Yonover | B63C 9/20 441/106 |
| 7,387,225 | B2 * | 6/2008 | Fox | A45F 3/14 224/257 |
| 7,438,619 | B2 * | 10/2008 | Staver | A41D 7/001 441/115 |
| 9,365,269 | B2 * | 6/2016 | Kazazian | B63C 9/115 |
| 9,420,872 | B2 * | 8/2016 | Bird | A01M 31/004 |
| 2005/0276664 | A1 * | 12/2005 | Semeia | A44B 11/04 405/186 |
| 2008/0160849 | A1 * | 7/2008 | Steger | B63C 9/135 441/122 |
| 2011/0165805 | A1 * | 7/2011 | Berry | A63B 31/00 441/122 |
| 2011/0200395 | A1 * | 8/2011 | Couzyn | B63C 11/02 405/186 |

* cited by examiner

*Primary Examiner* — Andrew Polay

(57) ABSTRACT

A floatation device for use by an individual in a body of water, comprising of an upper body covering and two fabric covered inflatable sleeve elements. The upper body covering contains multiple gussets that hide the male or female end of a clasp device. The fabric covered inflatable sleeves contain the opposite end of the clasp device which allow them to be securely fastened to the upper body covering in one or more locations.

4 Claims, 5 Drawing Sheets

FLOATATION DEVICE

FIELD OF THE INVENTION

The present invention relates generally to flotation devices for use by individuals in bodies of water, and relates specifically for an improved flotation and sun protection device for use by children in swimming pools and other such bodies of water.

BACKGROUND

Every year, there are numerous drowning deaths attributed to unattended children in public and private swimming pools and other open bodies of water. There are a variety of flotation devices available for use in pools, such as long tubes of styrofoam (commercially known as "noodles"), full body "life vests", inflatable rings, inflatable rings in the shape of animals, and inflatable arm bands, among others.

Currently, the most popular device is a set of "water wings", also known as "floaties" or "swimmies". These devices are two inflatable bladders that form a ring around each arm of the user. Once inflated with air, these "water wings" sit high on the user's arms and keep the user afloat. They are buoyant, so the arm is naturally lifted to the surface, together with the user. They are individually slid onto one or both arms.

The inflatable bladders are kept on the arms by friction created between the skin and the bladder, or by the natural bend of the elbow, or the force of the arms against the water surface. Essentially, there presently is no safe or consistent method of keeping these arm bladders in place on the arms.

When worn by children, these devices typically must be put on by an adult—which usually means that at some point the children try to remove them. Anecdotally, children are known to remove one or both water wings as soon as the adult turns their back, creating an unsafe situation. Alternatively, one or both of the water wings can slip off while the child is playing either in or before entering a pool. Apart from being intentionally removed from the arms by the child, the wings may come off accidentally.

Another danger facing all individuals, be they young or old, is sun exposure. Children are especially susceptible to sunburns and long term overexposure. It has been shown that sun exposure in the first 10 years of life partly determine a persons lifetime potential for skin cancer.

The most popular method of protecting children from sun exposure is sunscreen. However, even when a broad spectrum sunscreen is applied, it does not offer full protection from the sun. It must be applied 20 minutes before the child goes outside and reapplied frequently. Sweat, dirt and water can all have an impact on the efficacy of the sunscreen.

Thus, there remains a need to secure inflatable arm band flotation devices on the arms of a user, and in particular on children, to inhibit accidental or unintentional removal of one or both devices and protect the same from sun overexposure.

SUMMARY OF THE INVENTION

The present invention relates to an improved flotation device with sun protection. In an embodiment of the invention, a shirt is used, comprising of full percentages or blends of heavyweight natural fibers that have a tight the fabric structure, whether knitted or woven. These include, but are not limited to, cotton, linen and hemp or lightweight synthetics such as polyester, nylon, lycra and/or polypropylene.

In an embodiment of the invention, the shirt includes a selectively operable clasp assembly on the front and back of each upper arm/shoulder area. The clasps can be hidden from view under fabric or visible on the surface.

In an embodiment of the invention, the flotation device includes first and second flexible sleeve, torso or chest elements, each including a closed, selectively inflatable region or comprised of foam or another buoyant material.

In an embodiment of the invention, the front and back sides of the sleeve, torso or chest elements each includes a selectively operable clasp assembly. The inventive device may include a permanent coupling between shirt and one of or both sleeves, torso or chest on the front and or back of each.

In an embodiment of the invention, the selectively operable clasp on the front and back of each sleeve, torso or chest couple to the selectively operable clasp on the shirt.

In an embodiment of the invention, at least one inflatable region includes a valve assembly selectively operable to allow inflation of at least one inflatable region or no inflatable regions if comprised of foam or another buoyant material.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

A flotation device that provides improved safety from drowning and from sun exposure for users, in particular for children, is disclosed. In an embodiment of the invention, the device includes two inflatable, foam or other buoyant material sleeves, each of which are worn on the arms, around the torso or chest of the user. The foam or other buoyant material or inflatable sleeves are secured to a shirt using a clasp assembly on the arms/shoulders of the user. This embodiment, and others, are disclosed in further detail below.

Figure 1:
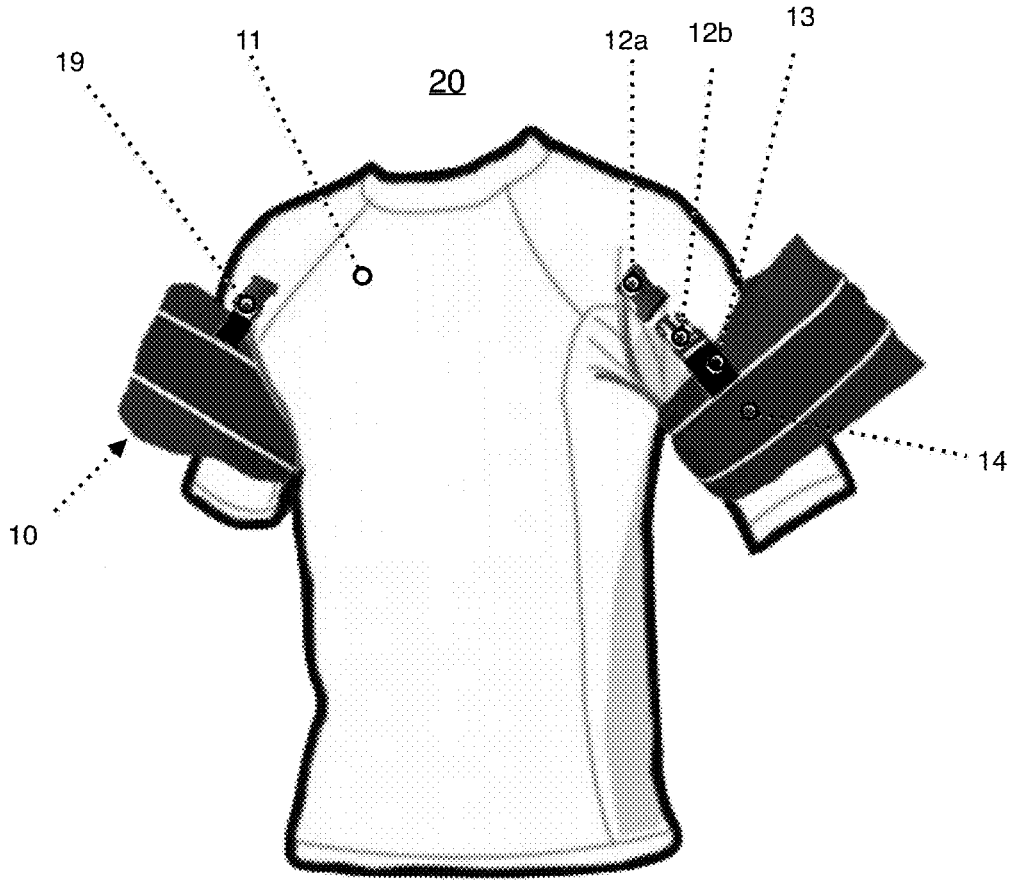
FIG. 1 is a perspective view of a flotation device of the present invention.

FIG. 1 shows the flotation device 20 of the present invention. As illustrated, the version of the device 20 includes two inflatable sleeves, also may be comprised of foam or another buoyant material 10, through which a user inserts his/her arms. The sleeves 10 are inflatable bladders made from any commercially available rubber, pliable plastic, synthetic, or other waterproof material or may be non-inflatable and comprised of foam or another buoyant material. In addition to being pliable and waterproof, the material must have sufficient durability to resist punctures or tears that may occur while the sleeve 10 is in its inflated or uninflated state. In a preferred embodiment, the material is a pliable plastic, foam or another buoyant material, covered with a soft, waterproof fabric for maximum comfort.

Figure 2:
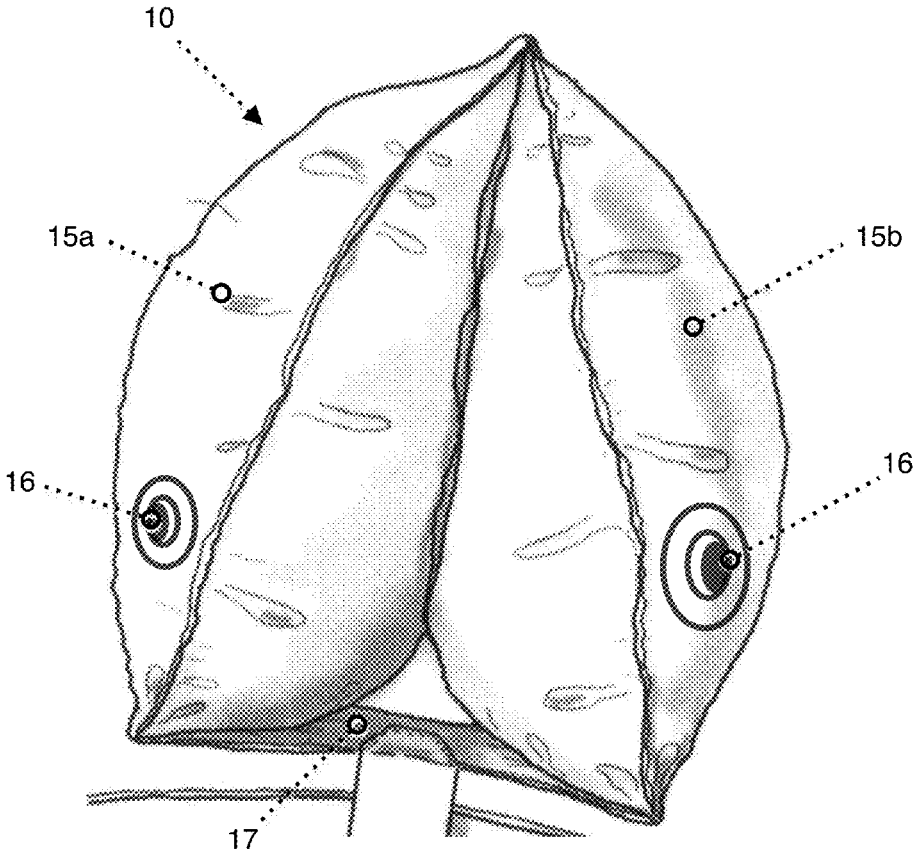
FIG. 2 is a perspective view of a flexible sleeve element of the present invention.

The inflatable sleeve 10 may be made from a single bladder, or multiple bladders together or comprised of foam or another buoyant material. As shown in FIG. 2, the inflatable sleeve 10 may consist of two separate bladders 15*a*, 15*b* which are joined along an end seam, and which have a non-inflatable joiner segment 17 therebetween. Alternatively, the sleeve 10 may include multiple bladders that encircle the user's arm and which are separately inflatable, or which may be inflated from a single input source.

As further shown in FIG. 2, if not comprised of foam or another buoyant material, the inflatable sleeve 10 includes one or more valve assemblies 16. Each bladder 15*a*, 15*b* may include an integral valve assembly 16. If the flexible sleeve 10 is made of a single bladder element 15, then each element would have an integral valve assembly 16. The valve assembly 16 of the present invention may be of any commercially available type, such as an HI-472, commercially available from Ho Lee Co., Ltd. The valve assembly 16 may be a self-inflating type, a manual inflation type, or others that are generally commercially available. The valve assembly 16 is inserted through the wall of the sleeve element 10 such that it acts as a conduit for air to enter into the bladder 15 for inflation and deflation. The valve assembly 16 may be held in place using waterproof glue, a plastic weld, heat-welding, waterproof tape, or any other such securing means generally commercially available and appropriate for securing the particular type of valve. In a preferred embodiment, the valve is secured using plastic or heat welding.

The flotation device 20 further includes an elongated, flexible strap assembly 19. The strap assembly 19 secures the flexible sleeve elements 10 to the shirt and thus the user and substantially inhibits the sleeves 10 from accidentally slipping off of the user's arms or from around the users torso or chest. When the device 20 is used with children, the strap assembly 19 makes it more difficult for a young child to remove the device 20 without adult assistance.

The strap assembly 19 includes a strap 13 that of sufficient length to ensure that it goes from the sleeve 10 to the shoulder of a range of users. The strap 13 may be manufactured from a flexible, waterproof material, such as a soft fabric, rubber, plastic, nylon, or other synthetic material. In a preferred embodiment, the strap 13 is made from woven elastic for its properties of having elastic properties and being waterproof. It is preferable that the strap material is elastic or at least partially consists of elastic fibers so that it is capable of returning to its original length after being stretched. With this material, the strap 13 can expand when it is being positioned on the user, then contract snugly from the sleeve to the shoulder region of the user once in position. The length of the strap 13 will depend on the intended user. Thus, the length may be a predetermined length for adult, youth, and child users.

The flotation device 20 further includes a clasp assembly comprised of a female end 12*a* and male 12*b* end. The shirt 11 will contain the female end 12*a* in one or multiple locations. In the present invention the female end 12*a* is integrated into the shirt in four locations, the front and back of each shoulder/sleeve area. The male end 12*b* is integrated into the strap 13 of the sleeve, torso or chest element 10. When the user places the sleeve elements on their arms, torso or chest the two ends 12*a*/12*b* are engaged, securing the sleeve element 10 to the shirt 11 which is worn by the user.

Figure 4A:
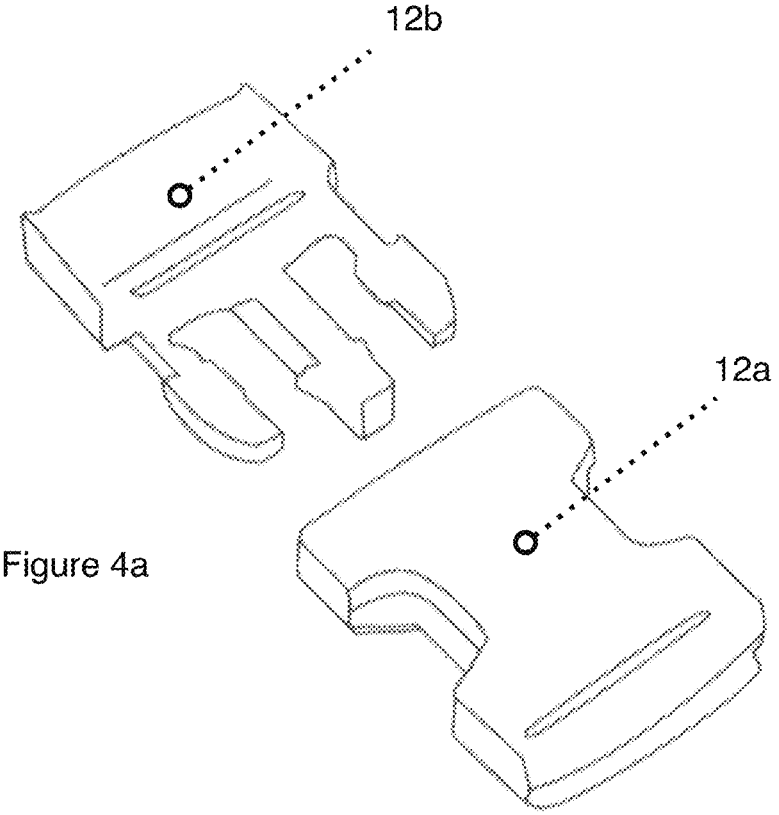
FIG. 4A is a perspective view of a slide release buck type clasp assembly of the present invention.
Figure 4B:
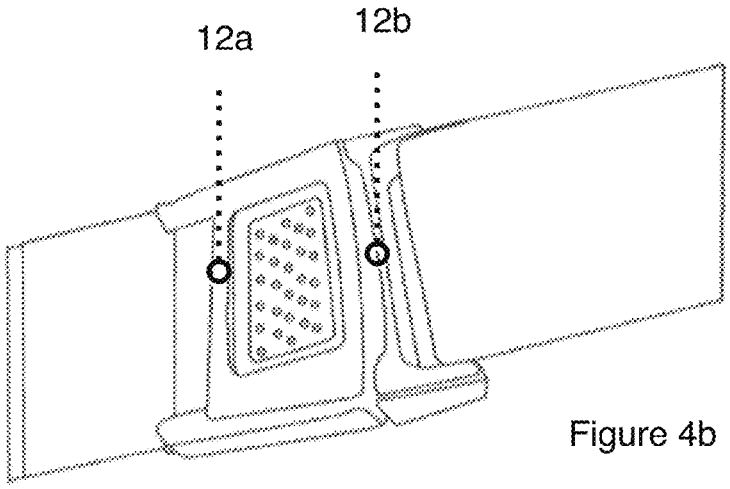
FIG. 4B is a perspective view of a center release buckle type clasp assembly of the present invention.

The assembly 12*a*/12*b* is waterproof and selectively operable. Several types of such assemblies 12*a*/12*b* are generally commercially available and may include a plastic slide release buckle, as shown in FIG. 4A, a plastic center release buckle, as shown in FIG. 4B. Other forms of clasp assemblies 12*a*/12*b* include Velcro® assemblies, snap assemblies, traditional belt buckle assemblies, or other devices that will secure the two ends of the strap. The clasp assembly 12*a*/12*b* may be positioned in the front and/or the back of the user, depending on the nature of the clasp assembly 12*a*/12*b* and whether it is an adult user or child user of the flotation device 20.

Figure 3A:
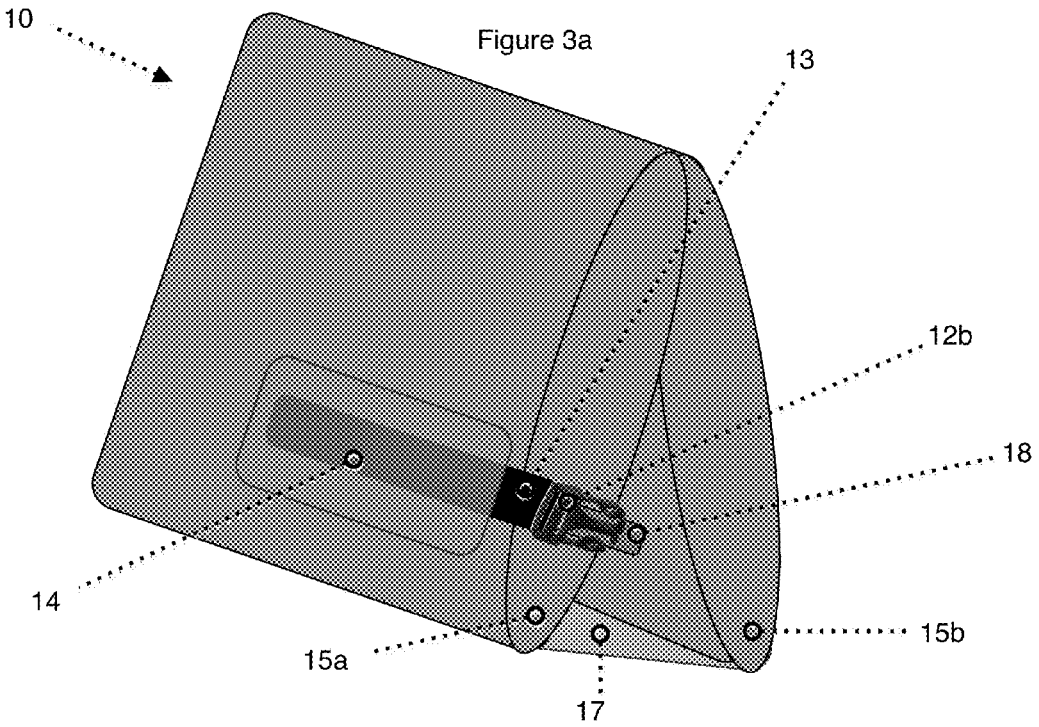
FIG. 3A is a perspective view of the sleeve of the present invention with the clasp extended.
Figure 3B:
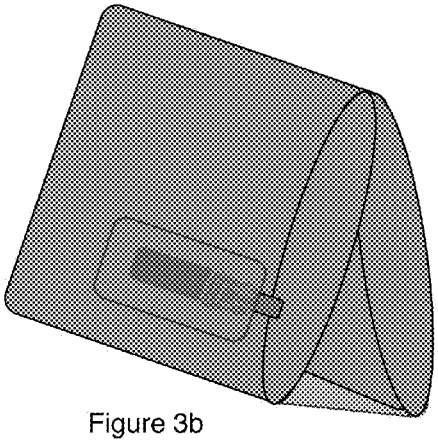
FIG. 3B is a perspective view of the sleeve of the present invention with the clasp retracted.
Figure 3C:
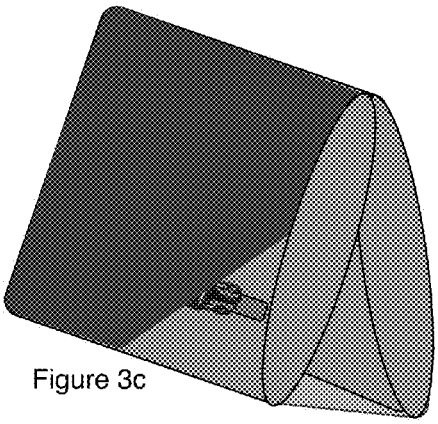
FIG. 3C is a perspective view of the sleeve of the present invention with the clasp retracted.

FIG. 3A shows a sleeve element 10 with the strap assembly 13 extended, exposing the male clasp 12*b* and a pull tab 18 for ease of use. A compartment 14 is created in the covering of the sleeve element 10 which can conceal the strap assembly 13 and the male clasp 12*b*. FIG. 3B shows the strap assembly 13 and male clasp 12*b* retracted and concealed in the compartment 14 with only the pull tab 18 showing. FIG. 3C shows an alternative embodiment using the sleeve covering design to create the compartment 14.

Figure 5:
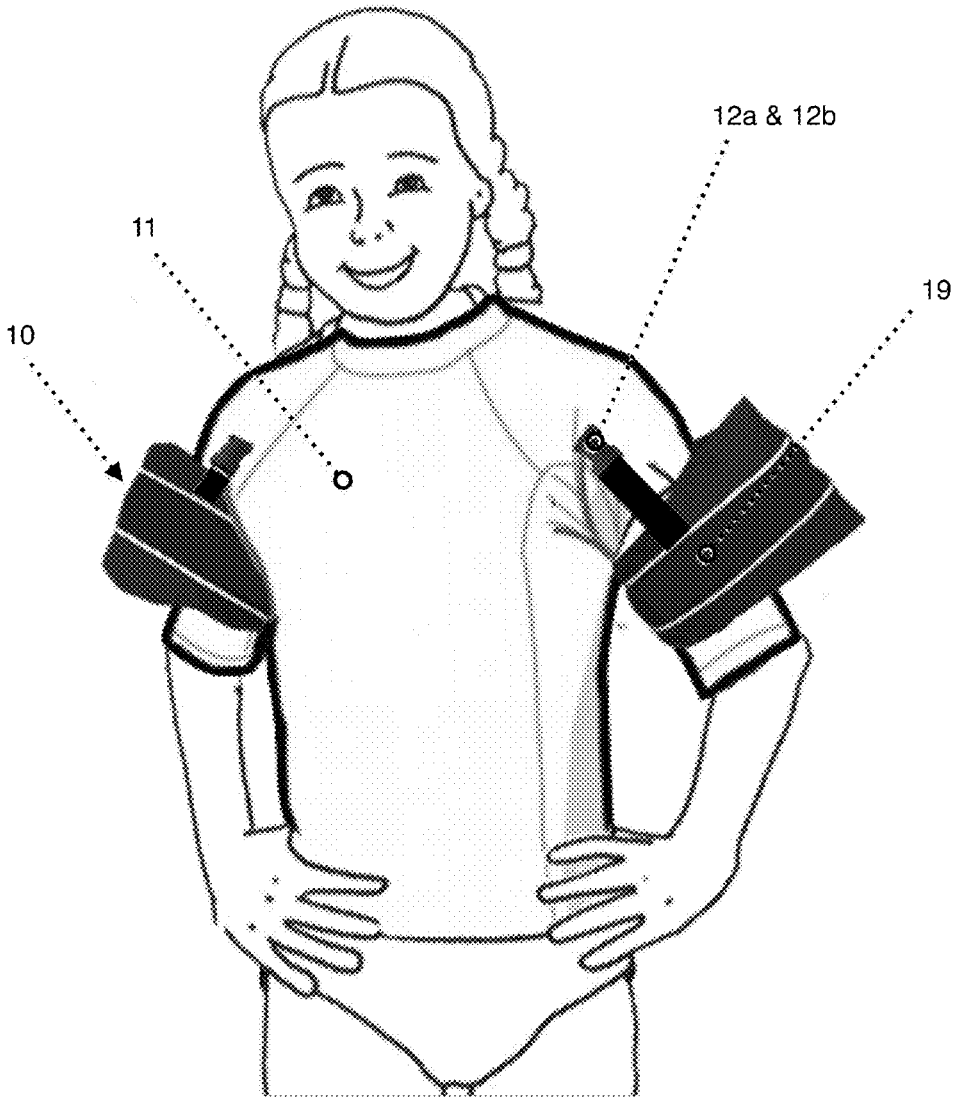
FIG. 5 shows the present invention worn by a user.

FIG. 5 shows one embodiment of the flotation device 20 positioned on a child user. In a preferred method of using the flotation device 20, the user puts on the shirt 11 and inserts his/her arms through each of the flexible sleeve elements 10, and sliding them all the way up to the users under arms. The strap 13 is extended to the users shoulder in the front and the clasp assembly 12 is then engaged to secure the front of the sleeve 10 element to the shirt. The process is repeated for the clasp assembly 12 on the back of the shirt sleeve. The process is then repeated again for the front and back of the other shirt sleeve, securing both sleeve elements 10 to the user.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A flotation device for use by an individual in a body of water, comprising:

A. A shirt with integrated female clasps on the front and back of each shoulder/sleeve, B. A first flexible sleeve or torso or chest element including at least one closed, selectively inflatable region, or foam or other buoyant material, C. A second flexible sleeve or torso or chest element including at least one closed, selectively inflatable region, or foam or other buoyant material, D. A flexible strap with male clasp extending from the sleeve element to the female clasp on the shirt.

2. A flotation device according to claim 1 wherein the male end of the strap assembly on the first sleeve element and the female end of the clasp integrated into the first shirt sleeve effects a selectively releasable coupling between the first sleeve, torso or chest element and the first sleeve on the shirt.

3. A flotation device according to claim 1 wherein the male end of the strap assembly on the second sleeve, torso or chest element and the female end of the clasp integrated into the second shirt sleeve effects a selectively releasable coupling between the second sleeve element and the second sleeve on the shirt.

4. A flotation device according to claim 1, if not foam or another buoyant material, wherein at least one inflatable region includes a valve assembly selectively operable to allow inflation of at least one inflatable region.

* * * * *